US006176816B1

(12) United States Patent
Dicker et al.

(10) Patent No.: US 6,176,816 B1
(45) Date of Patent: Jan. 23, 2001

(54) ENERGY EXPENDITURE/TRAINING GARMENT

(76) Inventors: Timothy P. Dicker, 6906 Foothill Blvd., Tujunga, CA (US) 91042-2780; William T. Wilkinson, P. O. Box 73, Salem, NJ (US) 08079

( * ) Notice: Under 35 U.S.C. 154(b), the term of this patent shall be extended for 0 days.

(21) Appl. No.: 09/221,487

(22) Filed: Dec. 24, 1998

Related U.S. Application Data

(62) Division of application No. 08/892,669, filed on Jul. 14, 1997, now Pat. No. 5,857,947.

(51) Int. Cl.[7] ..... A63B 21/02
(52) U.S. Cl. ..... 482/124; 2/69.5
(58) Field of Search ..... 482/124; 602/61, 602/19; 422/122, 124, 125; 2/69, 69.5

(56) References Cited

U.S. PATENT DOCUMENTS

| | | | |
|---|---|---|---|
| 1,178,165 | | 8/1916 | Lupton . |
| 2,097,376 | | 10/1937 | Marshman . |
| 2,613,932 | | 10/1952 | Manners . |
| 2,664,566 | | 1/1954 | Mianulli . |
| 3,411,500 | | 11/1968 | Gatts . |
| 3,559,654 | | 2/1971 | Pope . |
| 3,759,510 | | 9/1973 | Jackson . |
| 4,065,814 | | 1/1978 | Fox . |
| 4,220,299 | | 9/1980 | Motter . |
| 4,325,379 | | 4/1982 | Ozbey . |
| 4,384,369 | | 5/1983 | Prince . |
| 4,625,336 | | 12/1986 | Derderian . |
| 4,670,913 | | 6/1987 | Morell . |
| 4,698,847 | | 10/1987 | Yoshihara . |
| 4,850,056 | | 7/1989 | Gardner et al. . |
| 4,910,802 | | 3/1990 | Malloy . |
| 4,953,856 | | 9/1990 | Fox . |
| 4,961,573 | | 10/1990 | Wehrell . |
| 4,968,028 | | 11/1990 | Wehrell . |
| 4,993,705 | | 2/1991 | Tolle . |
| 5,033,123 | | 7/1991 | Audet . |
| 5,046,194 | | 9/1991 | Alaniz . |
| 5,060,315 | | 10/1991 | Ewing . |
| 5,062,642 | | 11/1991 | Berry . |
| 5,109,546 | | 5/1992 | Dicker . |
| 5,141,223 | | 8/1992 | Block . |
| 5,176,600 | | 1/1993 | Wilkinson . |
| 5,186,701 | | 2/1993 | Wilkinson . |
| 5,201,074 | | 4/1993 | Dicker . |
| 5,203,754 | | 4/1993 | MacLean . |
| 5,256,119 | | 10/1993 | Tudor . |
| 5,263,916 | | 11/1993 | Bobich . |
| 5,267,928 | | 12/1993 | Barile . |
| 5,282,277 | | 2/1994 | Onozawa . |
| 5,306,222 | | 4/1994 | Wilkinson . |
| 5,308,305 | | 5/1994 | Romney . |
| 5,336,139 | | 8/1994 | Miller . |
| 5,357,637 | | 10/1994 | Moore . |
| 5,367,708 | | 11/1994 | Fujimoto . |
| 5,372,565 | | 12/1994 | Burdenko . |
| 5,375,610 | | 12/1994 | Lacourse . |
| 5,383,235 | | 1/1995 | Peters . |
| 5,465,428 | | 11/1995 | Earl . |
| 5,518,480 | | 5/1996 | Frappier . |
| 5,518,481 | | 5/1996 | Darkwah . |
| 5,570,472 | | 11/1996 | Dicker . |
| 5,592,401 | * | 1/1997 | Kramer . |
| 5,659,895 | | 8/1997 | Ford, Jr. . |
| 5,733,201 | * | 3/1998 | Caldwell et al. . |

* cited by examiner

*Primary Examiner*—Michael A. Brown
*Assistant Examiner*—Lalita M. Hamilton
(74) *Attorney, Agent, or Firm*—Connolly Bove Lodge & Hutz LLP

(57) ABSTRACT

An energy expenditure garment includes various elastic resistance elements located on the garment so as to help in the training of a user while participating in a swinging sport, such as golf or racquet sports. The garment could also include a biofeedback sensor to indicate when a proper swing has or has not been performed.

10 Claims, 4 Drawing Sheets

ENERGY EXPENDITURE/TRAINING GARMENT

CROSS-REFERENCE TO RELATED APPLICATION

This application is a division of Ser. No. 08/892,669, filed Jul. 14, 1997 is now U.S. Pat. No. 5,857,947.

BACKGROUND OF THE INVENTION

The present invention relates to garments which would be used during an exercise or sport involving swinging an object, such as a golf club or racquet. Garments for expending energy have been known which incorporate elongated elastic resistance elements as separate cords or bands or as panels of the garment. In use of the garments when the user performs certain activities such as bending motions of the hands, legs or body, energy is expended in stretching the resistance material and then in resisting the material returning to its original condition. It would be desirable to make use of such concepts where the activity performed is a swinging of a club or racquet, such as in playing golf or various racquet sports such as tennis, racquetball, etc. It would also be desirable if such a garment could be used as an aid in training to assure a proper swing.

SUMMARY OF THE INVENTION

An object of this invention is to provide a garment particularly designed for use during the performing of a swinging exercise.

A further object of this invention is to provide such a garment which incorporates some form of indicator to alert the user that the proper swing is not being performed.

In accordance with one embodiment of this invention various forms of golf training/resistance exercise garments are provided having appropriately located resistance elements to promote the proper swing path and body positioning.

In accordance with another embodiment of this invention the garment is particularly designed for use in racquet style sports and locates the resistance elements as well as compression bands in appropriate portions of the garment.

In accordance with further aspects of this invention the garment includes various biofeedback structure such as in the hat or on a glove to alert the user when the swing is not proper.

THE DRAWINGS

DETAILED DESCRIPTION

Figure 1:
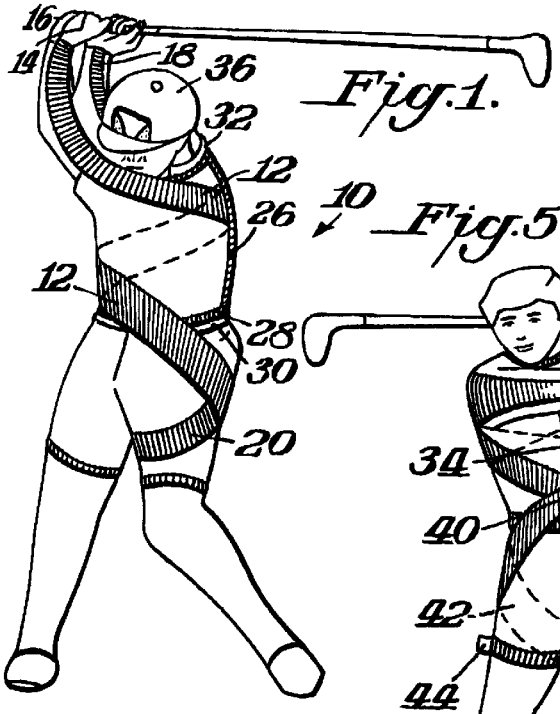
FIG. 1 is a front elevational view of a garment in accordance with one embodiment of this invention in a short pants version.

There are a number of sports that require a swing or stroke. Examples of such sports include golf, tennis, squash, paddleball, racquetball, baseball, hockey, street hockey, lacrosse and cricket. In the broad aspect of this invention the various garments disclosed herein, where appropriate, may be used for any of such exemplary sports. The invention, however is particularly directed for garments used in golf, racquet sports (such as tennis) and baseball.

The invention, in general, relates to one or more garments and accessories that are worn by a player and can include either in combination or as separate items one piece body suits, two piece body suits, shirt portions of a garment, pants portions of a garment, hats, gloves and shoes.

The invention is designed to achieve one or more of the following:

1. Training. The garment assists in developing proper swing/stroke.
2. Strengthening. The garment strengthens the muscles, particularly those used in the swing by providing resistance exercise.
3. Aerobic. The garment provides both aerobic and strengthening exercise while a player walks or runs or during the game or practice.
4. Support. The garment provides support for various parts of the body and helps to reduce fatigue thereby increasing endurance and to reduce strains/injury.

Training structures can be of any suitable design, but preferably are elastic in nature. The elastic elements could be a permanent part of or integral with the garment or could be detachable from the garment. The elastic resistance elements could be adjustable or non-adjustable in resistance force. The resistance elements act to restrain, restrict, and/or guide the motion of a player to help establish the correct form and range of motion during a swing/stroke. The elastic resistance elements also help with the stance or approach to the shot.

The garments of the invention can be used as a training aid or tool while performing during actual competition. Primarily the garments are designed as a training and strengthening and conditioning garment to be used during practice or casual play.

Exercise is primarily provided by resistance structures that are permanently attached to or incorporated in the garment or can be detachable from the garment. The resistance structures can be of any design such as a mechanical friction brake or cords, but are preferably elastic bands or sections that are incorporated into the garment. Reference is made to provisional application Ser. No. 60/026,969 filed Sep. 20, 1996, the details of which are incorporated herein by reference thereto and which describes various resistance techniques. Greater aerobic and strengthening exercise is achieved as the user walks or runs about during playing. Strengthening of the swing muscles is achieved by working against resistance during training or practice while in one spot such as on a driving range and to a lesser degree during play.

In a preferred form of this invention a one or two piece garment, i.e. one piece body suit or pants and top is provided. Both the top and pants would have elastic resistance bands that provide resistance to the arms/shoulders and to the legs/hips. The resistance helps to control rotation that occurs during the back swing/upswing and during forward/downswing. The resistance bands are preferably adjustable in tension/resistance force to allow a player to vary the resistance depending on the training goal desired such as correct swing form or proper range of motion or strengthening of the arms, shoulders, legs and hips.

The resistance can also be used to achieve a higher aerobic workout and thereby strengthen muscles while walking or running during play or practice.

Additionally, the garments and accessories can also be equipped with mechanical or preferably electronic indicators such as a buzzer or light to indicate proper or improper swing or stance form. Colored stripes, marks, bands, sections, etc. can be provided on the garment as indicia to provide a visual reference point similar to a warning track zone. For example, these indicia could be located on a portion of the garment which should not be seen in a proper stroke. Where, however, the arm is bent or twisted in an undesired manner the indicia would be seen thereby alerting the user that the stroke or swing is not proper. Similarly, numbers, letters or symbols can be used on the clothing for reference points. A variation would be to provide these indicia at locations where they should be seen during a proper stroke and thus, if not seen the player knows that the stroke was not proper.

In the description of the later described garments reference will be made to elongated resistance elements. Such resistance elements could be integral with or separate from the garment and could take the form of cords or bands or integral panels of the garment. Reference is made to our U.S. Pat. Nos., 5,109,546, 5,176,600, 5,186,701, 5,201,074, 5,306,222, and 5,570,472, as well as pending application Ser. No. 627,426 filed Apr. 4, 1996, Ser. No. 761,290 filed Dec. 6, 1996 and Ser. No. 802,973 filed Feb. 20, 1997. All of the details of the aforenoted patents and applications are incorporated herein by reference thereto. Such patents and applications disclose suitable materials for the base fabric of the garment and for resistance elements and compression bands.

FIG. 1 illustrates a garment 10 in accordance with this invention. As shown therein garment 10 includes an elongated resistance band 12 which is anchored at one end 14 to the wrist or arm in any suitable manner, such as in the aforenoted patents or applications or by use of a form of glove 16. As illustrated, the band 12 is secured to the outer side of the left hand and extends up the left hand and over the shoulder to the back of the garment. A further band 18 is anchored to the inner or palm side on the right hand and extends up the right arm to be joined with the band 12. The opposite end 20 of the band 12 is anchored at the left leg. In the embodiment shown in FIG. 1, the garment 10 is of the short patents version and the opposite end 20 is anchored in any suitable manner as noted in the aforenoted patents and applications. Band 20 may extend to the end of the shorts and be anchored to a compression cuff or band 20 itself may be the anchoring compression cuff. The band 12 extends in a spiral manner and is located at the anterior thigh, lateral hip and extends posterior to anterior to encircle the mid thigh. As illustrated the band 12 extends up the left hip and loops around the torso upwardly around the back and shoulders and down the outside of the left arm into the hand.

Figure 2:
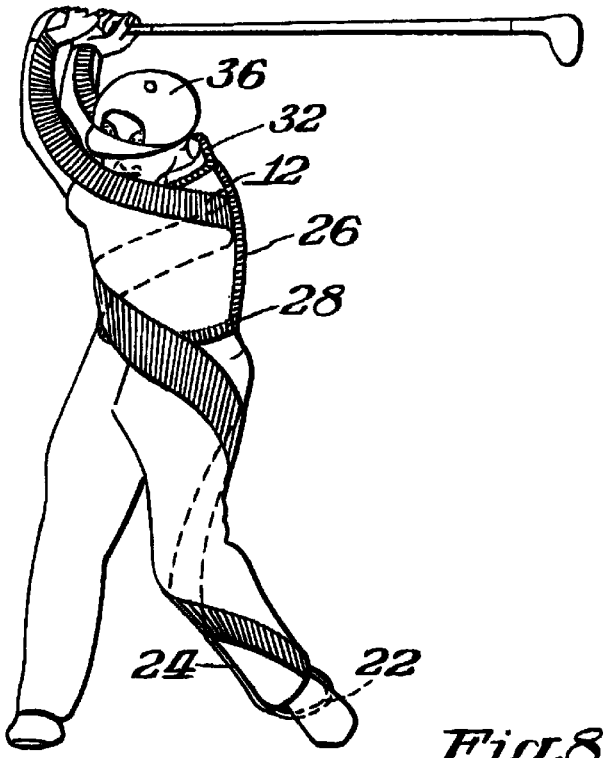
FIG. 2 is a view similar to FIG. 1 wherein the garment is of a long pant version.

FIG. 2 illustrates a variation of the garment 10 which is of the long pants or full length form. As shown therein the band 12 continues in its spiral around the left leg from the anterior thigh/lateral hip downward to the posterior thigh to the knee then to the medial knee and crosses over the lateral calf forming a stirrup 28. A portion of the band 24 extends to the medial calf forming a closing loop for the stirrup 22.

As also illustrated in FIGS. 1–2 the garment includes a resistance band 26 at the posterior central axis as part of a central banding system which would further include a resistance loop 28 generally at the waist. The upper portion of posterior band 26 includes a collar loop 32 to anchor the band 26 at both the neck and waist portions.

Garment 10 could further include a waistband 30 which could be adjustable such as by means of a buckle and would be used preferably where the garment is of two piece construction with a separate top and pants portions.

As later described the garment could further include a cap 36 which incorporates a biofeedback sensor.

Figure 3:
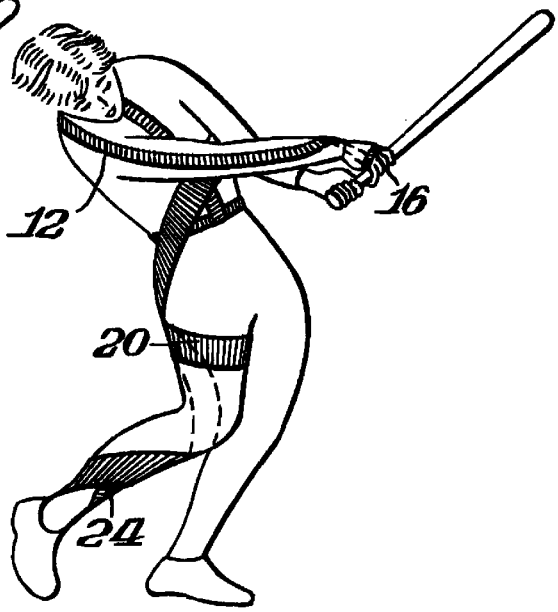
FIG. 3 is a front elevational view similar to FIG. 1 showing a garment when the user is in the follow through portion of a swing.

FIG. 3 illustrates the garment when the user is in the follow through portion of the swing whereas FIG. 2 shows the user at the beginning of the swing. A further difference of the garments shown in FIGS. 2 and 3 is that FIG. 2 illustrates the band 12 to extend in a spiraling direction which begins its spiral from the left hand whereas FIG. 3 illustrates the spiral to begin from the right hand. In FIG. 3 a central axis band 34 is located at the front of the garment. The central banding system can include posterior axial band 26 and/or anterior axial band 34.

FIG. 3 further illustrates the same garment to include the band end 20 as well as the stirrups 22. In actual practice, however, the band 20 would be used only in the short pants version, while the stirrups would be used only in the long pants version.

The garment 10 of FIGS. 1–2 provides resistance loading and promotes the proper swing path and body positioning. With the garment of FIG. 3 to complete the swing the arms move to the left pulling the right hip to the correct position. The spiraling of the band 12 in FIG. 3 would be from the right hip/torso to loop around the back over the shoulders and down the right outside arm. In the shorts version the band 12 would loop around the hip down the bottom of the shorts and then encircle the leg in that location. With the full pants version the band 12 would be located behind (posterior thigh) to the medial knee then the lateral calf to form the stirrup and back to the medial calf 24 joining the band upon itself and thereby completing the loop.

Figure 4:
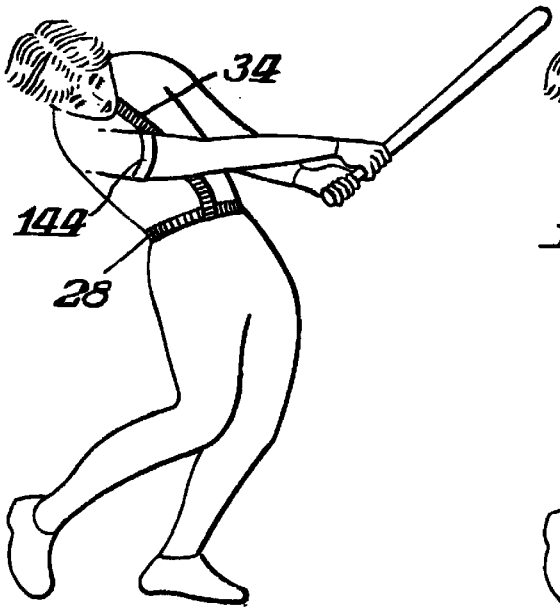
FIG. 4 is a view similar to FIG. 3 showing a portion of the garment of FIGS. 1–3.

FIG. 4 illustrates a follow through view of a garment which includes a central anterior axis band 34 preferably made of a median tension material such as 10% nylon. This is in contrast to the bands 12 made of high tension material such as high nylon. As illustrated in various figures, such as FIGS. 1, 2 and 5–6 the bands 26 and 34 extend upwardly to loop around the neck and form the neck band 32 and downwardly to loop around the waist and form the waistband 28. The purpose of the central axis band system is to provide biofeedback stimulus for central rotation orientation.

In general, the main fabric of the garment would have low resistance as compared, for example, to the elongated resistance elements having high resistance. In various embodiments medium resistance material could be used such as for the banding system illustrated in FIG. 4.

Figure 5:
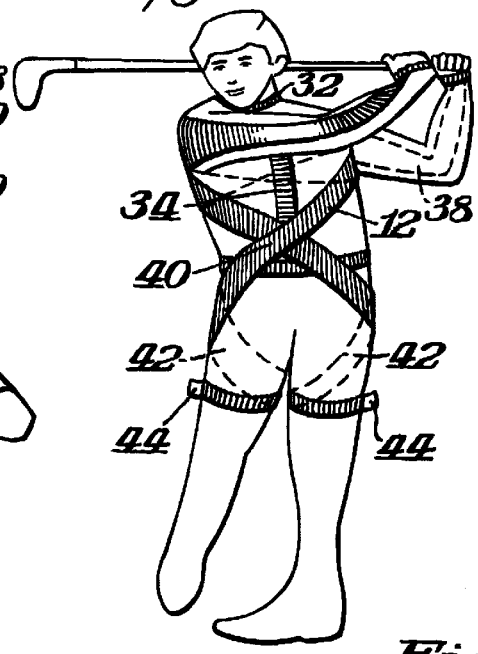
FIG. 5 is a front elevational view of a modified form of garment in the short pants version in accordance with this invention.

FIG. 5 illustrates a combination of the spiral bands 12 in the shorts version of FIGS. 1 and 3 where a spiral band 12 extends along both sides of the body. FIG. 5 illustrates the garment 10 to further include the central axis band system.

Figure 6:
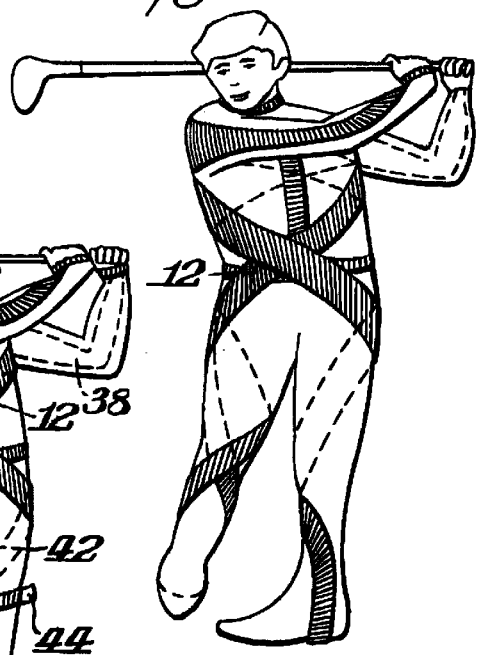
FIG. 6 is a view similar to FIG. 5 showing a garment in the long pants version.

FIG. 6 similarly illustrates a combination of both versions in a long pants garment. As shown therein the right arm band rolls over to the palm side of the hand and promotes wrist roll for proper ball strike. The bands 12 further include a posterior left arm portion 38 with a portion 40 of the bands 12 at the anterior hip to promote proper hip, twist and weight transfer.

FIGS. 5–6 also illustrate posterior leg band portions 42 of the bands 12. Additionally, FIG. 5 shows the band 20 used in the short pants version to have free ends 44 which would be secured together to form a loop in any suitable manner and preferably by some adjustable means such as buckles or VELCRO® (hook and loop fasteners). This form of band end 20 would be used with the embodiments of FIGS. 1 and 3. The central axis band 34 is also illustrated in FIGS. 5–6.

Figure 7:
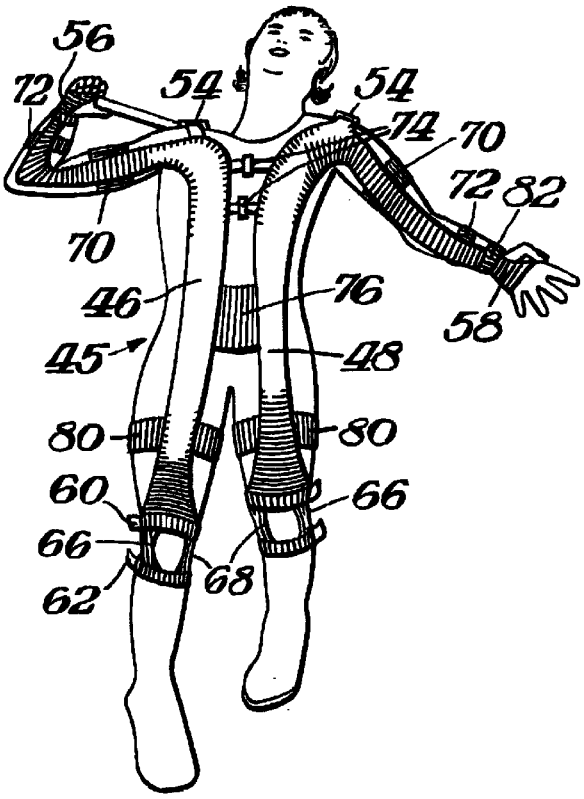
FIG. 7 is a front elevational view showing a further garment in accordance with this invention.
Figure 8:
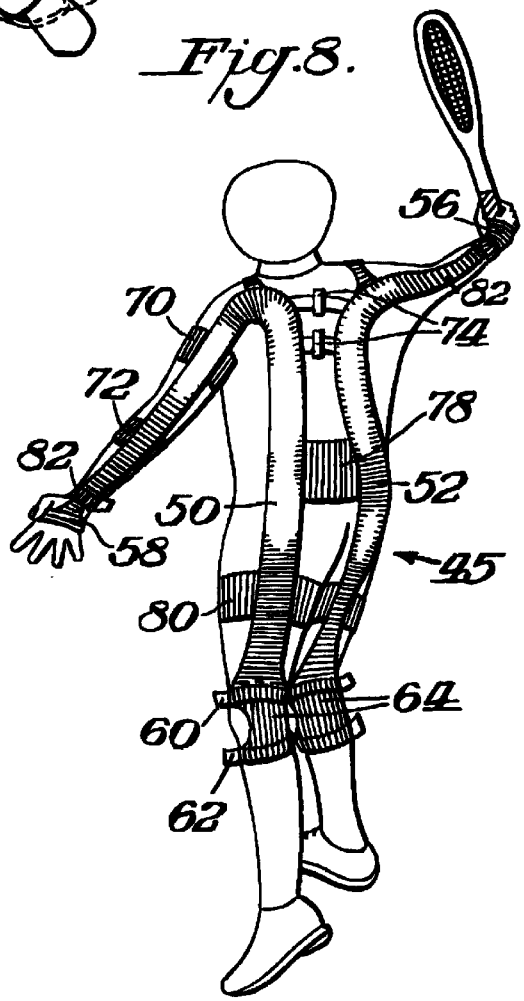
FIG. 8 is a rear elevational view of the garment shown in FIG. 7.

FIGS. 7–8 illustrate a garment 45 particularly designed for use in racquet sports. As shown therein two independent anterior bands 46,48 are provided with band 46, for example, being for the left side of the body and band 48 being for the right side of the body. FIG. 8 shows a posterior band 50 provided for association with band 48 with a second posterior band 52 provided for association with band 46. Each band is connected to its associated band by some adjustable interconnecting structure such as a strap 54 extending from each band with the free ends of the straps 54 suitably adjustably connected to each other as by a buckle, VELCRO®, etc.

FIG. 7 shows the free ends of the band 46 and 52 to be anchored to a common hand loop 56, while the free ends of the bands 48,50 are anchored to a common hand loop or glove structure 58. Either a hand loop or glove structure may be used for either set of bands. The opposite ends of the bands 46,48 50,52 are also anchored to common anchoring structure. FIGS. 7–8 show the garment to be a short pants version wherein the anchoring structure would be accomplished by being secured to band 60 which encircles the leg above the knee. Preferably this anchoring is provided in an adjustable manner for band 60 by having the free ends of the band 60 secured together with any suitable adjustable securing structure such as buckles, belts, VELCRO®, etc. A further anchoring loop 62 is provided below the knee similar to loop 60 and a collateral ligament support band 64 interconnects loops 60,62, as shown in FIG. 8 FIG. 7 shows lateral collateral ligament support bands 66 and medial collateral ligament support bands 68 preferably made of high resistance material such as high nylon. The loops 60,62 may be made of a material such as neoprene.

The various main resistance bands 46,48, 50,52 are preferably interconnected to each other in an adjustable manner. As noted, the connecting straps 54,54 which connect the right side bands to each other and connect the left side bands to each other are adjustable so as to thereby permit proper control or selection of the desired tension. Similarly, adjustable straps 74 are provided with a set of straps interconnecting the anterior bands 46 and 48 and a similar set of straps 74 connecting the posterior bands 50,52. The adjusting straps, particularly strap 74,74 would permit adjusting tension for practicing different shots.

The garment 45 also includes a plurality of compression bands or rings around the large muscles and to pool blood. FIG. 7, for example, illustrates each arm to include a bicep/tricep compression ring 70 and to include large muscle compression rings 72 on the forearms of the user. Hamstring/quadriceps compression rings 80 are also provided. The compression rings are preferably made of high nylon fabric and function to pool the blood particularly at the extremities thereby increasing endurance.

As shown in FIG. 7 an abdominal panel or support 76 is provided between main anterior bands 46 and 48. Similarly, a lumbar support panel 78 is provided between posterior main bands 50,52. The support panels are preferably made of high nylon material.

FIGS. 7–8 further illustrate wrist bands 82 which may be used as the anchoring elements for the main bands or may be used in addition to the anchor elements. Thus the anchoring of the main bands 46,48, 50,52 may be accomplished in various manners such as by the illustrated hand loop or glove 56,58 or the wrist bands 82. The anchoring could be by means of a full glove or half finger glove or the types of gloves generally used for golf, biking, swimming, rollerblading, etc.

The garment shown in FIGS. 7–8 is particularly useful in racquet type sports. The resistance biased suit builds strength. The compression rings or bands around the extremity muscles promotes blood/oxygen pooling thereby increasing endurance. The garment also provides vertical adjustability above the shoulders, knee adjustability and chest and scaplar adjustability for specific shot training. In addition abdominal/lumbar structural support is provided.

FIGS. 9–12 are directed to a further variation of this invention wherein the garment could be of one piece or two piece construction having an upper portion or shirt 84 and a lower portion 86. In general, the garment would be provided with adjustable tension/elastic resistance bands preferably incorporated into the garment itself at integral panels. The garments shown in FIGS. 9–12 are particularly intended for golf and racquet sports and would be used to train and strengthen the swing, provide aerobic exercise when walking or running and to give support to the low back and knees. Preferably the garment is used for training and conditioning purposes rather than actual play in competition. Also, preferably the adjustments to resistance/tension are bi-directional so as to permit the user to balance the resistance and restrict/adjust the range of motion and to accommodate both left and right handed users.

Figure 9:
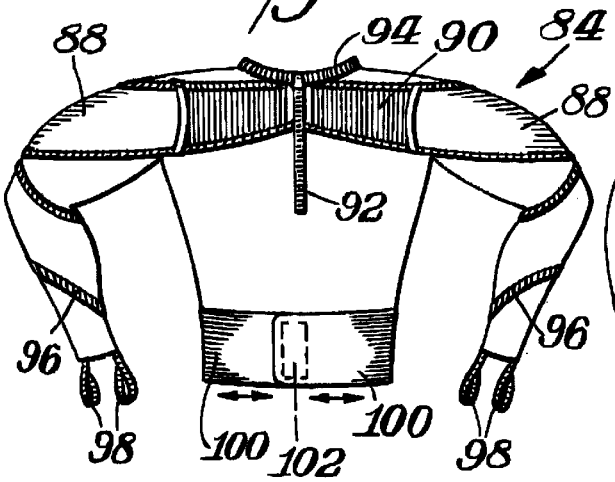
FIG. 9 is a front elevational view of still yet another garment in accordance with this invention in the form of a shirt.
Figure 10:
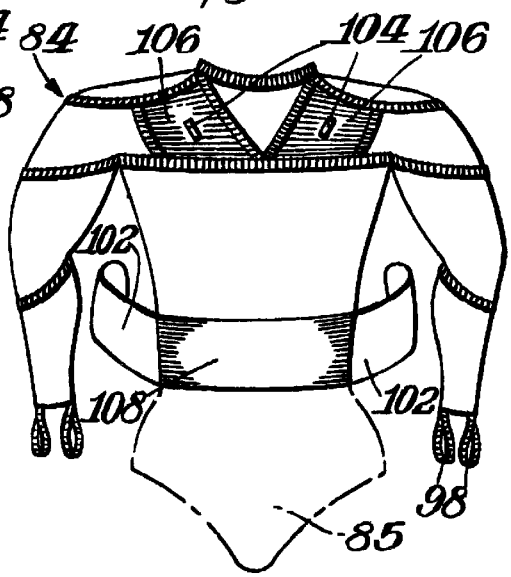
FIG. 10 is a rear elevational view of the shirt shown in FIG. 9.

FIGS. 9–10 illustrate a shirt or top portion 84 of the garment. The garment itself may generally be of a jersey or leotard type and is referred to as a top portion or shirt because the various resistance elements are contained from the waist upwardly. FIG. 10 shows a leotard extension 85. As shown, FIG. 9 is the anterior view of shirt 84. Shirt 84 includes an elastic band 88 on each side thereof. The main length or portion of the band 88 is integral with the main portion of shirt 84. The end of each band, however, is separate from shirt 84 to form an adjustable flap 90 for securement to the main fabric of the garment to adjust the tension in band 88. Any form of adjustable securement may be used such as buckles, VELCRO®. The center of the garment includes, for example, a zipper 92 extending from the collar 94 downwardly to permit the garment to be placed on the user. An elongated elastic arm resistance band 96 is provided on each arm and extends spirally down the arm to terminate in a hand loop 98. Alternatively, the end of the resistance band 96 may be anchored in any other manner, such as by wrist loops, gloves, etc. A waistband 100 is shown which is adjustable in tension from a circumferential standpoint by having the ends of the waistband secured together in any suitable manner such as a by VELCRO® connecting flap 102 to permit a tighter or looser tensioning in accordance with the desired back support.

FIG. 10 shows the elastic bands 88 to include a hasp 104 at the ends of the VELCRO® flaps 106 for secondary locking purposes. Such a hasp may be provided for each adjustable flap or band end.

It is to be understood that instead of elastic bands 88 a non-elastic strap could be used which would provide a restraint or control of the limit of range or motion of the user.

As shown in FIG. 10 the top 84 may also include a foam/plastic lumbar insert 108 in the waistband.

Figure 11:
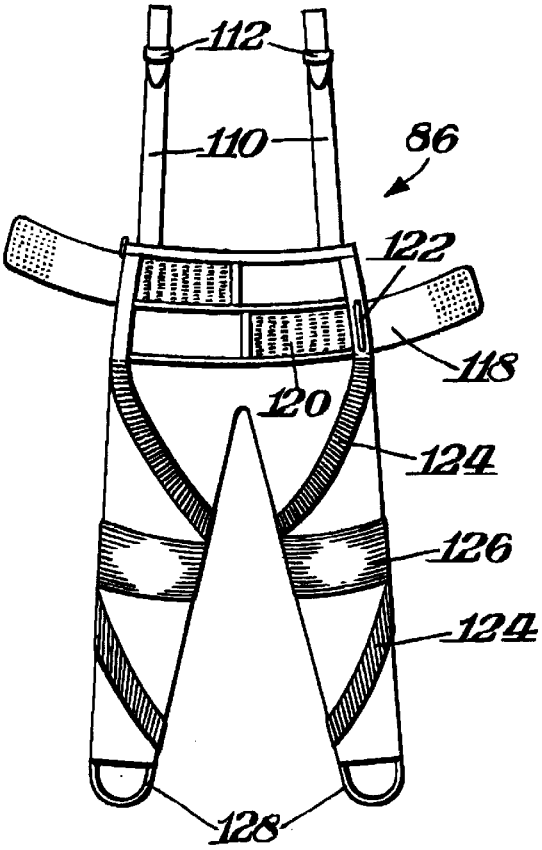
FIGS. 11–12 are front and rear elevational views of forms of pants for garments in accordance with this invention which may be used with the shirt of the garment shown in FIGS. 9–10.
Figure 12:
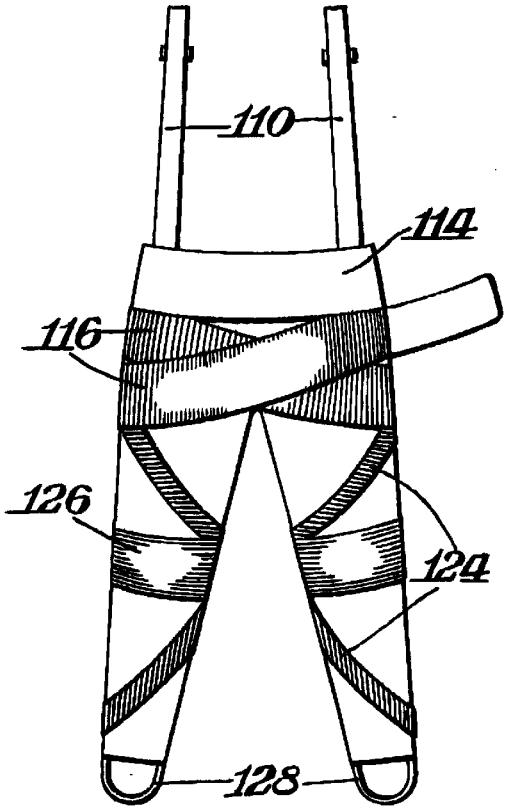

FIGS. 11–12 illustrate the bottom or pants portion 86 of the garment. FIG. 11 shows the anterior portion which would include suspenders 110 having length adjustment and tensioning structure, such as buckles 112. If desired, the suspenders could be omitted and the pants 86 could be secured directly to the shirt portion 84 either permanently or detachably. As best shown in FIG. 12, a low back support belt 114 may be provided. A pair of crossing elastic hip control bands 116 is also shown which cross in the posterior and are secured in the waist area in the anterior or front. The hip control bands terminate in flaps 118 which contain, for example, VELCRO® fasteners 120. Hasps 122 may also be provided. This arrangement adjusts the tension on the hip. The front and back VELCRO® adjustment straps can run through the same side of the hip hasp so as to pull against each other in opposite directions.

Elastic resistance leg bands 124 are also provided as well as elastic knee support bands 126. The leg bands 124 are anchored in any suitable manner such as foot stirrups 128 or may be anchored to the shoes or to compression ankle cuffs.

Figure 13:
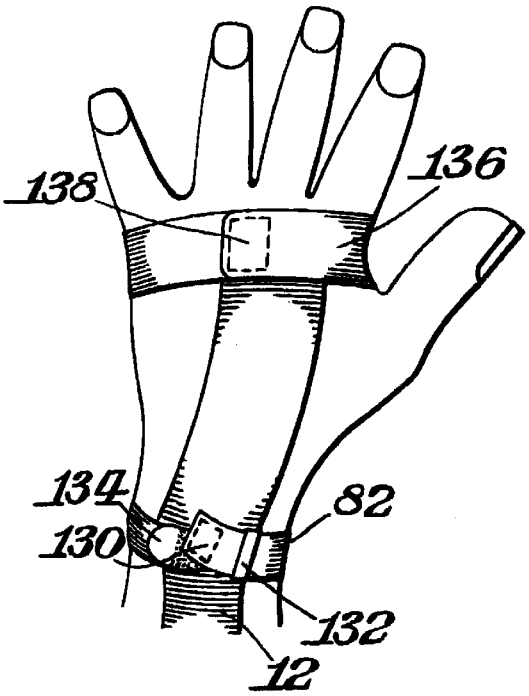
FIG. 13 is a rear elevational view showing the hand portion of a garment which includes a biofeedback sensor in accordance with this invention.

In accordance with a further aspect of this invention biofeedback structure is provided for the garment to alert the player as to when a swing is proper or not proper. FIG. 13 illustrates one form of biofeedback structure. As shown therein the wristband 82 has a pair of free ends 130 secured together by any suitable manner such as VELCRO® structure with the VELCRO® flap 130 extending through hasp 132. A biofeedback sensor 134 is provided on wristband 82. The wristband 82 would be used in conjunction with main resistance band 12 which is shown as anchored to hand loop 136 adjustably secured around the hand by having a VELCRO® flap 138 at its free end. The biofeedback sensor 134 could operate similar to a mercury switch wherein an alarm would be sounded if the sensor 134 is tilted out of its desired position during a swinging motion. Thus, as long as the swing is proper the sensor 134 remains in its intended plane and no alarm is sounded. If an alarm is sounded the player knows that there has been an improper swing.

Figure 14:
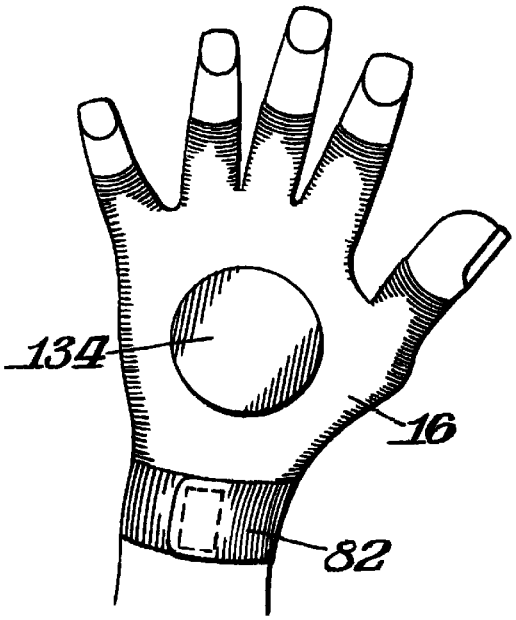
FIG. 14 is a view similar to FIG. 13 of a modified form of biofeedback sensor.

FIG. 14 illustrates a variation wherein the garment includes a wristband 82 and a glove 16 with the biofeedback sensor 134 being mounted on the back of the glove 16. The glove, as noted, could be a full glove or a half glove wherein the fingers are exposed or any other suitable glove.

Figure 15:
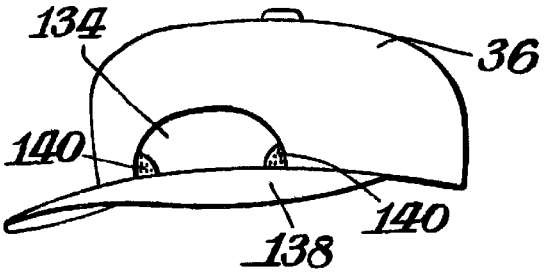
FIGS. 15–16 illustrate forms of caps or hats which incorporate a biofeedback sensor.
Figure 16:
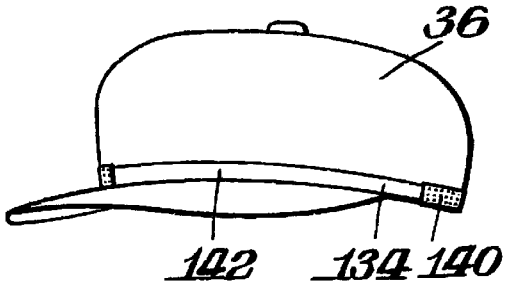

FIGS. 15–16 illustrate a variation of the invention wherein the biofeedback sensor is incorporated in a hat design. As shown therein the cap or hat 36 of FIG. 15 includes the biofeedback sensor 134 above the rim or peak 138. FIG. 15 also illustrates the audible outlets 140 for the sensor 134. In operation an audible signal or alarm would be given when the head is lifted or tilted off center.

FIG. 16 shows a variation wherein the biofeedback sensor 134 is incorporated in a strap 142 located at the rim or bill of the cap 36. The audible outlets 140 are located at the ears of the wearer so that a loud audible alarm need not be made.

Other forms of structure could be used to alert the user as to when the swing is proper or not proper. FIG. 4, for example, illustrates a colored stripe 144 near the shoulder of the user. The stripe would be located at any suitable position on the garment to either indicate that a proper swing has been achieved or to indicate that the swing is improper. Where it is intended to indicate a proper swing, the stripe would be located so as to become visible to the player at, for example, the completion of stroke. If the stripe is not visible the player knows that the swing was not proper. Conversely, the stripe or indicia could be placed at a location which would only be visible if the stroke were not proper, such as by too much of a twist or otherwise at a location representative of an improper follow through. Any suitable indicia could be used including having a series of numbers, letters, or designs which would become progressively visible during an improper swing. This would have the advantage of alerting the user as to where in the swing the deviation from a proper swing begins to occur.

It is to be understood that the various features shown in individual embodiments may be incorporated in other embodiments within the concepts of this invention.

What is claimed is:

1. An energy expenditure/training garment having a body portion with a right arm and left arm extending therefrom and with a right leg and left leg extending therefrom, each of said body portion and said arms and said legs having a longitudinal axis, a left anterior elongated elastic resistance band extending anteriorly from and in surface contact with and integral with said left arm to said left leg and over said body portion, a left posterior elongated elastic resistance band extending posteriorly from and in surface contact with and integral with said left arm to said left leg and over said body portion, a right anterior elongated resistance band extending anteriorly from and in surface contact with and integral with said right arm to said right leg and over said body portion, a right posterior elongated resistance band extending posteriorly from and in surface contact with and integral with said right arm to said right leg and over said body portion, said anterior resistance bands being mirror images of each other, said posterior resistance bands being mirror images of each other, each of said resistance bands being disposed generally parallel to said longitudinal axis of said respective body portion and arms and legs, said arms extending to at least a wrist portion, said legs extending to at least a knee portion, each of said elongated resistance bands being anchored to one of said wrist portions and being anchored at one of said leg portions, said left elongated resistance bands being connected to each other by straps, said right elongated resistance bands being connected to each other by straps, said anterior elongated resistance bands being connected to each other by straps, and said posterior elongated resistance bands being connected to each other by straps.

2. The garment of claim 1 wherein said straps are adjustable to adjust the tension provided by said elongated resistance bands.

3. The garment of claim 2 including a plurality of compression bands located on said arms and said legs.

4. The garment of claim 3 wherein said plurality of compression bands comprises sets of forearm compression bands, and bicep/tricep compression bands and hamstring/quadriceps compression bands.

5. The garment of claim 4 including a abdominal support panel between said anterior elongated resistance elements, and a lumbar support panel between said posterior elongated resistance elements.

6. The garment of claim 5 wherein said legs terminate above the knee, said elongated resistance elements being anchored by being connected to an anchoring ring above the knee, an anchoring rings being below the knee, and said anchoring ring being connected to each other by collateral ligament support straps.

7. The garment of claim 6 wherein said anchoring rings are adjustable.

8. The garment of claim 7 including adjustable wrist bands on each of said arms.

9. The garment of claim 8 including a biofeedback sensor for indicating when a proper/improper swing is made.

10. The garment of claim 1 wherein said straps are generally perpendicular to said resistance bands.

* * * * *